United States Patent [19]

Rohde

[11] 4,349,228

[45] Sep. 14, 1982

[54] METHOD FOR DEWATERING A SUBTERRANEAN FORMATION VIA A BOREHOLE

[75] Inventor: Edward C. Rohde, Fairmont, W. Va.

[73] Assignee: Consolidation Coal Company, Pittsburgh, Pa.

[21] Appl. No.: 101,354

[22] Filed: Dec. 7, 1979

[51] Int. Cl.[3] ..... E21C 41/00

[52] U.S. Cl. ..... 299/10; 166/50; 405/132

[58] Field of Search ..... 299/2, 12, 19, 10; 405/36, 132; 166/50, 285, 305 D

[56] References Cited

U.S. PATENT DOCUMENTS

| | | | |
|---|---|---|---|
| 435,648 | 9/1890 | Johnston | 299/19 |
| 893,988 | 7/1908 | Durack | 299/19 |
| 1,269,090 | 6/1918 | Kistler | 166/285 |
| 2,164,266 | 6/1939 | Armentrout et al. | 166/285 |
| 2,622,683 | 12/1952 | Silitch et al. | 405/36 X |
| 2,787,125 | 4/1957 | Benz | 299/2 X |

*Primary Examiner*—David H. Corbin

*Attorney, Agent, or Firm*—William A. Mikesell, Jr.; F. Lindsey Scott; Dale Lovercheck

[57] ABSTRACT

An improvement in a method for communicating the surface and a subterranean coal seam via a borehole positioned to provide access for the positioning of power transmission and fluid transmission lines from the seam to the surface, the improvement comprising; extending a portion of the borehole beneath the seam, casing at least a portion of the extension of the borehole and thereafter pumping water from the borehole extension.

3 Claims, 3 Drawing Figures

METHOD FOR DEWATERING A SUBTERRANEAN FORMATION VIA A BOREHOLE

This invention relates to the dewatering of subterranean formations.

This invention further relates to methods for dewatering coal seams in the vicinity of coal mines.

This invention further relates to an improvement whereby boreholes commonly used for the positioning of power transmission and fluid transmission lines from the surface to the coal mine are extended to provide a borehole beneath the level of the coal mine from which water may be removed.

In the mining of coal of various grades, from mines beneath the surface, a commonly occurring problem is water. Excess water in the mine area results in the operation of the mining equipment in mud which results in a substantial decrease in the efficiency of mining operations. Further, the digging of sumps in mines to remove water as presently practiced is time consuming and imposes an additional equipment requirement. The disadvantages of the excessive water in the mining operations are well known and constitute the aforementioned inefficiency in operations, the added disadvantages of hauling wet products, which tend to stick to the inside of the haulage vehicles and the like as well as a number of other problems not the least of which are electrical hazards associated with the presence of the excessive water in the mine vicinity. The excess water may be naturally present in the subterranean formations or the water may be artificially introduced water from nearby mining operations or even from the operations carried out in the particular mine for which the drainage system is designed. As is well known to the art, many mining operations involve the use of water which may then constitute excess or undesired free water in the mine.

In any event, the removal of such water is necessary and has been attempted by a variety of techniques heretofore.

In the development of such mines, boreholes are typically drilled from the surface to the mine seam at selected intervals to facilitate the entry of power transmission and fluid transmission lines into the mine. Typically the boreholes are drilled to the coal seam and for a short distance through the coal seam to establish that the seam has been reached with the boreholes thereafter being cased to a depth slightly above the top of the coal seam. The borehole is then used for power or fluid transmission line access as required as the mine advances through the seam beneath the borehole. It has now been found that the drainage of mines is facilitated by an improvement in such methods, whereby the borehole is drilled to a depth extending substantially beneath the bottom of the coal seam and thereafter cased, desirably with a perforated casing, to a depth constituting at least a portion of the total depth of the borehole beneath the coal seam with water thereafter being pumped from the borehole extension beneath the coal seam.

In the discussion of the figures, the same numbers will be used to refer to the same or similar components throughout.

Figure 1:
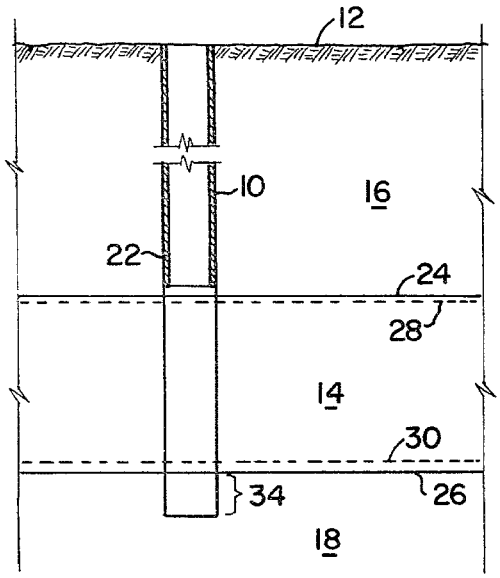
FIG. 1 (PRIOR ART)
FIG. 1 is a schematic diagram of a borehole as typically used to penetrate a subterranean coal seam.

In FIG. 1 and a borehole 10 is positioned from surface 12 through a formation 16 to a coal seam 14 which overlies another subterranean formation 18. The borehole, as drilled, is extended through coal seam 14 for a short distance 34 into subterranean formation 18 to establish thickness of the coal seam and the like. Borehole 10 is then desirably cased with a casing 22 which is normally cemented in place, as known to those skilled in the art, to a depth slightly above the top 24 of coal seam 14.

Figure 2:
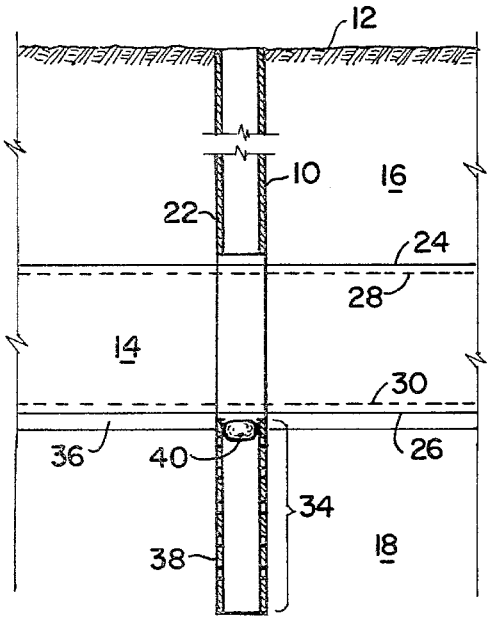
FIG. 2 is a schematic diagram of an embodiment of the present invention showing a borehole positioned through a subterranean coal seam and extending for a substantial depth beneath the coal seam; and, FIG. 3 is a schematic diagram of an embodiment of the present invention showing the borehole of FIG. 2 after development of the mine in the vicinity of the borehole.

In FIG. 2, a borehole 10 is positioned through formation 16 and cased as shown in FIG. 1 but borehole 10 is extended for a greater distance 34 beneath the bottom 26 of coal seam 14 and cased with a casing 38 which is desirably perforated to permit the entry of water. While depths below the seam of up to about 50 feet are considered suitable for most mines greater depths can be used if required. The top and bottom of the future mine are shown by dotted lines 28 and 30. A packer 40 is positioned in borehole 10 in the upper portion of the perforated casing and just beneath the bottom 30 of the mine. A water table36 is shown in FIG. 2 as being slightly beneath the bottom of coal deposit 14.

Figure 3:
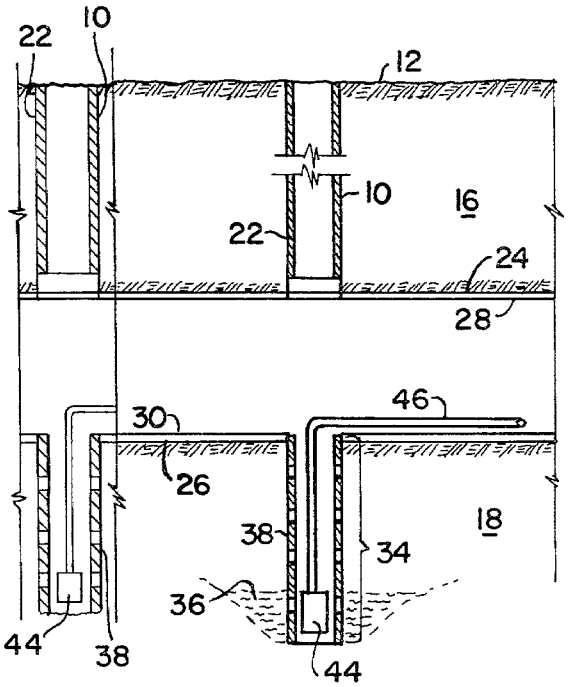

In FIG. 3, a pump 44 has been positioned in well bore 10 to pump water via a line 46 to mine drainage or the like. Water table 36 has been lowered as shown by pumping through line 46. The mine has been completed as shown by solid lines 28 and 30 showing the top and bottom of the mine. As will be evident from FIG. 3 the top of perforated casing 38 is desirably below the bottom of the mine so that the casing is not disturbed by the use of mining machinery and the like.

In the practice of the improvement of the present invention, it is possible that the subterranean formations could be dewatered from surface 12 before mining through the area, although such is less preferred since it requires the installation of expensive strings of piping, pumps and the like which must be removed prior to mining through the area. The preferred practice of the method of the present invention comprises the use of a packer positioned in the top of perforated casing 38 so that mining operations can pass above the portion of the borehole extending beneath the bottom of coal seam 14 with the portion of borehole 10 beneath coal seam 14 being left relatively undisturbed so that upon the removal of packer 40 pumping of water from the portion of borehole 10 beneath coal seam 14 can be readily commenced by simply installing a pump and transmission line for the removal of water to a mine water disposal system or the like. The water removed can be either naturally occurring subterranean water or artificially supplied subterranean water as discussed previously. It is desirable that a packer or the like be used so that the portion of borehole 10 extending beneath the bottom of coal seam 14 does not become plugged with debris and the like as mining operations proceed past borehole 10. Desirably at least a portion of borehole 10 is cased beneath coal seam 14 so that water can be removed from borehole 10 without plugging the pumps and the like. Desirably all of the portion of borehole 10 extending beneath coal seam 14 is cased with perforations being positioned in the casing as required for the flow of water into borehole 10. The pumps used are conventional pumps as known to those skilled in the art and do not warrant further discussion.

A primary advantage of the present invention lies in the use of a borehole which is already required in the normal operation of a mine which is adapted by the improvement of the present invention to accomplish a second required objective with a minimum of added expense and difficulty. The positioning of a cased portion of borehole 10 beneath coal seam 14 by the improvement of the present invention is relatively inexpensive and permits the positioning of a plurality of potential drainage sumps which can be used as needed throughout a wide area of a mine.

Having described the present invention by reference to certain of its preferred embodiments, it is pointed out that the embodiments shown are illustrative rather than limiting in nature and that many variations and modifications are possible within the scope of the present invention. Many such variations and modifications may be considered obvious and desirable by those skilled in the art upon a review of the foregoing description of preferred embodiments.

1. A method of installing a perforated casing beneath a subterranean seam of a carbonaceous deposit and mining through the deposit in the area of the casing comprising, providing a borehole said borehole comprising a seam portion extending through said seam and a lower portion below said seam portion, providing a perforated casing in said lower portion of said borehole, said casing having a top portion;

providing a packer in said top portion of said perforated casing, mining said seam, and then removing said packer from said top portion of said perforated casing, providing a pumping means in said perforated casing in said lower portion of said borehole, thereafter pumping water from said lower portion of said borehole.

2. The method of claim 1 wherein said lower portion of said borehole extends up to about fifty feet below said seam.

3. The method of claim 1 further comprising a plurality of said boreholes, each said borehole having a packer in said top portion of said perforated casing, each said perforated casing being in said lower portion of said borehole.

* * * * *